US005449096A

United States Patent [19]

Sedlmeier

[11] Patent Number: 5,449,096

[45] Date of Patent: Sep. 12, 1995

[54] PISTON FOR A DISPENSING TOOL

[75] Inventor: Andreas Sedlmeier, Ummendorf, Germany

[73] Assignee: Hilti Aktiengesellschaft, Fürstentum, Liechtenstein

[21] Appl. No.: 215,434

[22] Filed: Mar. 21, 1994

[30] Foreign Application Priority Data

Apr. 10, 1993 [DE] Germany ..... 43 11 876.3

[51] Int. Cl.[6] ..... B67D 5/42

[52] U.S. Cl. ..... 222/386; 92/247

[58] Field of Search ..... 222/326, 327, 386, 389; 92/181 P, 240, 247, 249; 604/125; 277/152, 212 C

[56] References Cited

U.S. PATENT DOCUMENTS

| | | | |
|---|---|---|---|
| 2,958,445 | 11/1960 | Jesse | 222/386 |
| 3,178,074 | 4/1965 | Sundholm | 222/386 |
| 3,612,359 | 10/1971 | Sundholm | 222/386 X |
| 4,452,370 | 6/1984 | Langensiepen et al. | 222/386 X |
| 4,733,792 | 3/1988 | Wasserman et al. | 222/386 X |
| 4,792,065 | 12/1988 | Soehnlein et al. | 222/386 X |
| 5,056,690 | 10/1991 | Ichihara et al. | 222/386 |
| 5,092,496 | 3/1992 | Gayle et al. | 222/386 |
| 5,295,615 | 3/1994 | Gentile | 222/386 X |
| 5,332,122 | 7/1994 | Herold et al. | 222/386 X |
| 5,370,282 | 12/1994 | Sedlmeier | 222/386 X |

*Primary Examiner*—Andres Kashnikow
*Assistant Examiner*—Kenneth R. DeRosa
*Attorney, Agent, or Firm*—Anderson Kill Olick & Oshinsky

[57] ABSTRACT

A piston (6) for a tool dispensing a mass from a foil bag (5) includes an axially extending piston rod (8) engageable with a central engagement part (14) of the piston and arranged to be pressed against the foil bag (5). A wipe-off edge (15) at least partially encircles and is located radially outwardly from the central engagement part (14). The wipe-off edge (15) is axially displaceable for a limited extent relative to the central engagement part (14).

10 Claims, 3 Drawing Sheets

8
6
14
9
27
B
26
16
15
22
28
29
23
21
29
13
21
18
19
20
25
17
5
4

PISTON FOR A DISPENSING TOOL

BACKGROUND OF THE INVENTION

The present invention is directed to a piston for use in a tool dispensing a mass from a foil bag. The piston has a central engagement part engageable with one end of an axially extending piston rod which displaces the piston. A wipe-off edge at least partially surrounds the central engagement part and projects radially outwardly from it.

Single or multi-component hardenable or curable masses are used for a great variety of applications, especially in the building construction industry. Such masses are commercially available in cartridges or foil bags and the mass is pressed out of the cartridge or foil bag by an appropriate dispensing tool.

A piston of such a dispensing tool is disclosed in the German patent publication P 42 31 420.8 and is made up of two individual pistons each having a central engagement part shaped in a cambered manner at its end face and a wipe-off edge projecting radially outwardly from and laterally enclosing the engagement part.

The piston is double acting and is located in a cylindrically shaped cassette part arranged to receive the foil bag with the cassette part forming a part of the dispensing tool, or, as an alternative, it can be placed into the tool as a separate part. The double-acting piston is displaceable in the cassette part. A piston rod with a thrust member axially displaces the piston. The cassette part is open at its opposite ends. After the contents of the foil bag are completely pressed out, the foil bag is in a collapsed condition and can be removed from the cassette part and a new foil bag filled with mass can be placed in the cassette part, however, in the opposite end of the cassette part from the piston. After the cassette part is aligned in position in the dispensing tool, it is inserted into the tool so that the next dispensing operation can be initiated.

A foil bag is collapsed or folded up in the course of pressing-out the mass and is at least partially received in the peripheral region about the central engagement part. Accordingly, the piston is designed so that each individual piston has a storage space in the outer circumferential region of the central engagement part extending from the end face region of the individual piston to the wipe-off edge.

Accordingly, the known piston has two storage spaces arranged axially in tandem and separated from one another by the wipe-off edges. The axial length of the piston depends upon the corresponding length of the storage spaces. As a result, the considerable required length for the storage spaces affects the overall length of the piston, the length of the cassette part and also the length of the dispensing tool itself.

SUMMARY OF THE INVENTION

The primary object of the present invention is to provide a double-acting piston with two storage spaces, whereby the piston is constructed so that it provides a reduced axial length of the cassette part and of the dispensing tool.

In accordance with the present invention, the wipe-off edge is axially displaceable to a limited extent with respect to the central engagement part.

The piston positioned within the cassette parts abuts the inside surface of the cassette part by means of a sealing surface of the wipe-off edge. When the piston is initially displaced in the axial direction, an axial displacement of the central engagement part takes place relative to the wipe-off edge. Due to such displacement, a sufficiently large storage area is formed in the peripheral region of the central engagement part facing in the dispensing direction, so that the storage space can receive the foil bag in its collapsed condition. Due to the axial displacement of the central engagement part relative to the wipe-off edge, the storage space on the opposite side of the engagement part becomes correspondingly smaller.

For effecting limited axial displacement of the central engagement part and the wipe-off edge, cooperating means interconnect both parts to form a single unit.

The cooperating means are formed by projections on the wipe-off edge extending radially inwardly toward the center of the central engagement part. These projections radially interconnect the wipe-off edge with the central engagement part. The axial displaceability of the wipe-off edge relative to central engagement part is assured by an appropriate formation of the radially outer surface of the central engagement part and the free ends of the projections. The projections are arranged so that they extend radially inwardly from the sealing region of the wipe-off edge.

The radially inner free ends of the projections are preferably T-shaped to afford better stability against tilting of the wipe-off edge relative to the central engagement part. The T-shaped ends extend at least partly in the axial direction and in the circumferential direction of the outer contour of the piston.

The cooperating means include guides formed by the central engagement part. The outer surface of the central engagement part is formed so that a guide is provided for the wipe-off edge whereby there is axial displacement of the edge relative to the central engagement part. For this purpose, the outer surface of the central engagement part has a cylindrical shape and is slotted in the axial direction so that the opposite ends of the slot limit the axial displaceability of the wipe-off edge.

To assure that the wipe-off edge of the piston does not rotate in the circumferential direction relative to the central engagement part, preferably the guides are slots extending in the axial direction of the central engagement part and are open at the radially outer surface of the central engagement part, whereby the slots cooperate with appropriately shaped projections on the wipe-off edge. The wipe-off edge projections are at least as long in the radial direction so that they project radially inwardly from the outer surface of the central engagement part or extend through the slots into the inside of the central engagement part. The ends of the projections extending into the central engagement part can be T-shaped. The T-shaped design serves to assure improved stability against tilting of the wipe-off edge relative to the central engagement part. The T-shaped end of the projections abut in the radially inward direction against a guidance surface in the central engagement part extending in the axial direction of the piston.

Due to the displaceable wipe-off edge, the size of the storage spaces on the opposite sides of the edge can be changed. The larger the axial displaceability of the wipe-off edge relative to the central engagement part, the larger is the respective storage space for the collapsed or folded up foil bag. To obtain a storage space as large as possible and, at the same time, a short axial length of the piston, the slots serving to guide the wipe-off edge extend preferably for 70% to 90% of the overall axial length of the central engagement part.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
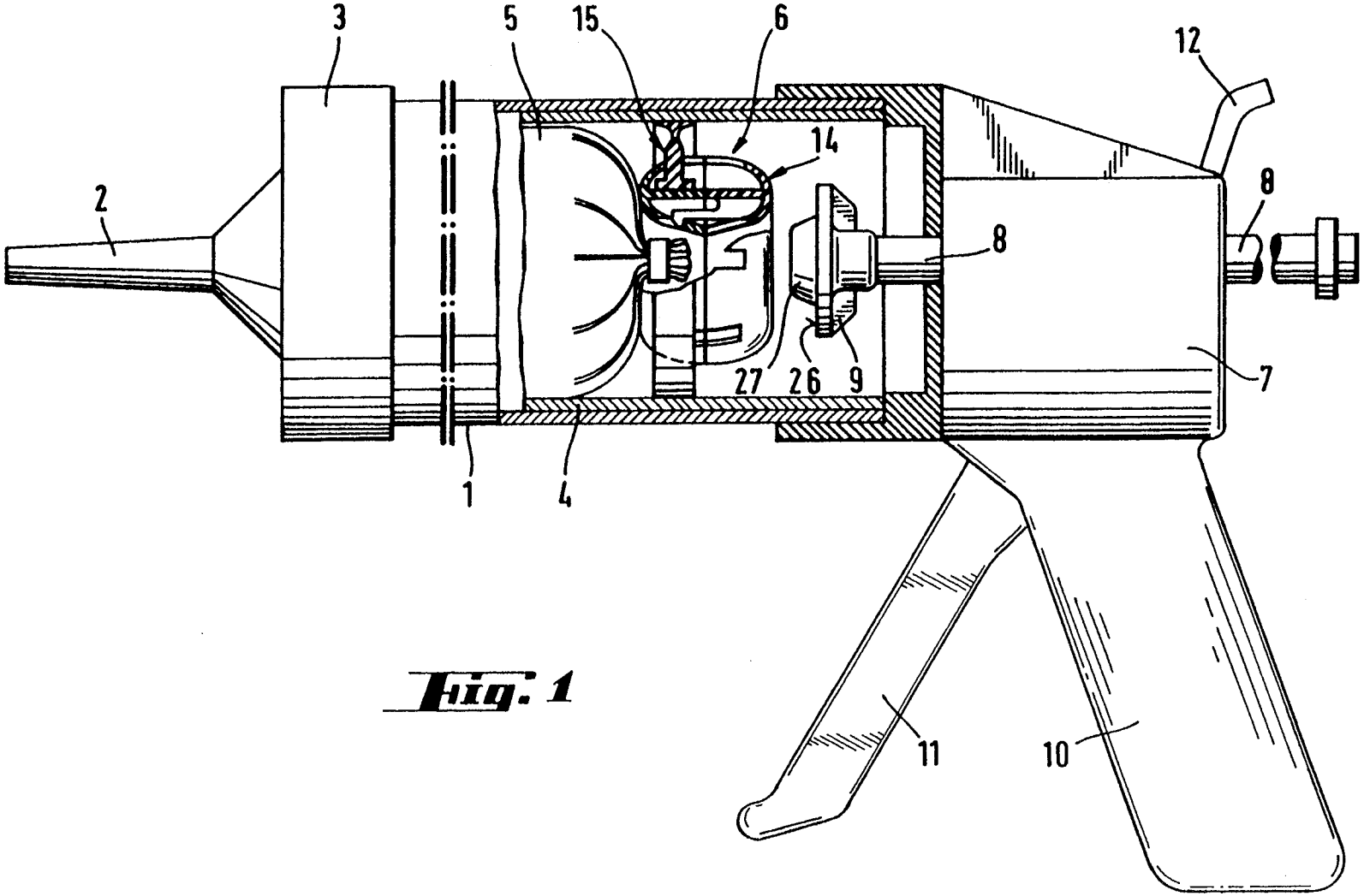
FIG. 1 is a side view, partly in section, of a dispensing tool incorporating a piston embodying the present invention.

In FIG. 1 a dispensing tool is illustrated including a central cylindrically-shaped housing 1 with a dispensing nozzle 2 at its front end, that is the left end in FIG. 1, and with a shut-off element 3 located at the front end of the housing. A cylindrical cassette part 4 contains a foil bag 5, and a piston 6, embodying the present invention, is located in the cassette part contacting the rear end of the foil bag.

A feeding or pressing mechanism 7 is connected to a piston rod 8 and is located in the rear region of the dispensing tool at the opposite end of the housing 1 from the nozzle 2. A thrust or pressure member 9 is located at the front end of the piston rod 9 and can be moved axially into engagement with a central engagement part 14 of the piston 6. By pressing the pressure member 9 against the piston 6, the central engagement part 14 presses against the foil bag 5 for dispensing the mass located within the bag. A handle 10 is located at the rear end of the housing 1, and a trigger 11 is pivotally mounted on the handle so that by pressing the trigger it can be moved toward the handle. The trigger 11 operates the feed mechanism 7, whereby the piston rod 8 is displaced in the dispensing direction by the feed mechanism 7. When the forward end position of the piston rod 8 is reached and the dispensing operation is completed, the connection between the feed mechanism 7 and the piston rod 8 can be interrupted by an unlocking arm 12 and the piston rod can be pulled rearwardly, opposite to the dispensing direction in an unhindered manner.

Figure 2:
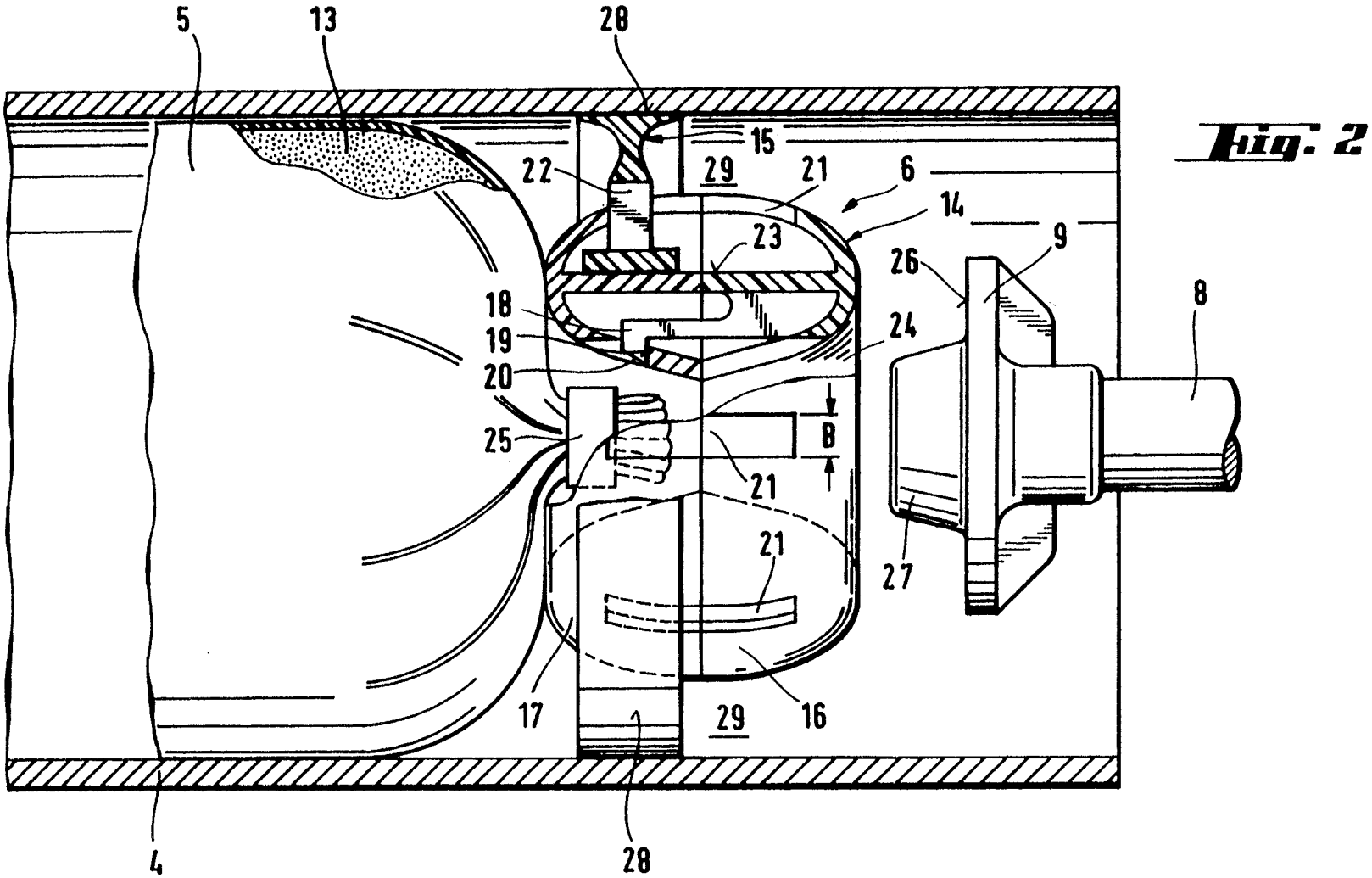
FIG. 2 is an enlarged axially extending illustration of the piston located within a cassette part of the tool and showing a foil bag and a piston rod with a thrust or pressure member prior to applying pressure against the foil bag.

FIG. 2 displays an enlarged illustration of the cassette part 4 with the foil bag 5 filled with a mass 13 and with the piston 6 of the invention located just contacting the rear end of the foil bag. A front end portion of the piston rod 8 with the pressure member 9 mounted on it is shown spaced rearwardly from the rear side of the piston 6. FIG. 2 shows the piston 6 in position prior to the commencement of the dispensing operation. The piston 6 is formed of two halves 16, 17 in contact at a parting plane extending transversely of the piston axis. The two halves 16, 17 are held together by a snap-in connection. The snap-in connection consists of a claw-like arm 18 extending axially from one half 16 of the piston 6 and engaged in a matching recess 19 in the other half 17 of the piston. An appropriate inlet bevel 20 on the end of the claw-like arm 18 assures that when the two halves 16, 17 are assembled, a radially inward displacement of the claw-like arm 18 is possible before it moves outwardly into gripping engagement with the corresponding recess 19.

The central engagement part 14 has several essentially uniform axially extending slots 21 in its radially outer circumferential surface. The slots extend in each of the halves 16, 17. The slots are closed at their axially spaced ends, so that the axially spaced ends serve as stops for radially inwardly extending projections 22 on the axially displaceable wipe-off edge 15. Slots 21 are formed as radially extending through openings in the radially outer circumferential region of the central engagement part 14. The slots 21 have a width B in the circumferential direction corresponding essentially to the thickness of the projections 22 of the wipe-off edge 15 also measured in the circumferential direction.

Wipe-off edge 15 projects radially outwardly from the central engagement part 14 and laterally encloses the central engagement part. The radial abutment and the axial guidance of the wipe-off edge 15 relative to the central engagement part 14 is effected by the projections 22 extending in the radial direction from the sealing region 28 of the wipe-off edge 15 towards the center or axis of the central engagement part. Projections 22 are formed as individual spokes each with a radially inner T-shaped free end. The T-shaped free end of the projections 22 abut against an axially extending guidance surface 23 inside the central engagement part, so that the wipe-off edge 15 has stability against tilting relative to the central engagement part 14. Since the projections 22 extend into the central engagement part 14 through the axially extending slots 21 of the central engagement part, turning of the wipe-off edge 15 relative to the central engagement part in the circumferential direction is prevented. The slots 21 form guides in which the projections 22 can only move axially.

The central engagement part 14 of the piston 6 has a central throughbore 24 serving to receive a closure element 25 on the rear end of the foil bag 5. The diameter of the throughbore 24 widens from the radially extending parting plane between the halves 16, 17 to the opposite ends of the central engagement part 14. Accordingly, the smallest diameter of the throughbore 24 is located midway between the ends of the central engagement part 14 where the two halves 16, 17 of the piston 6 meet.

The pressure member 9 on the front end of the piston rod 8 serves to entrain the piston 6 as the piston rod is displaced axially in the dispensing direction. The pressure member 9 has a projection 27 extending axially outwardly in the dispensing direction from a pressure face 26, with the projection essentially matched to the contour of the throughbore 24 in the rear end face region of the central engagement part 14. A storage space 29 is located in the circumferential region of the central engagement part 14 and is open towards the piston rod 8.

Figure 3:
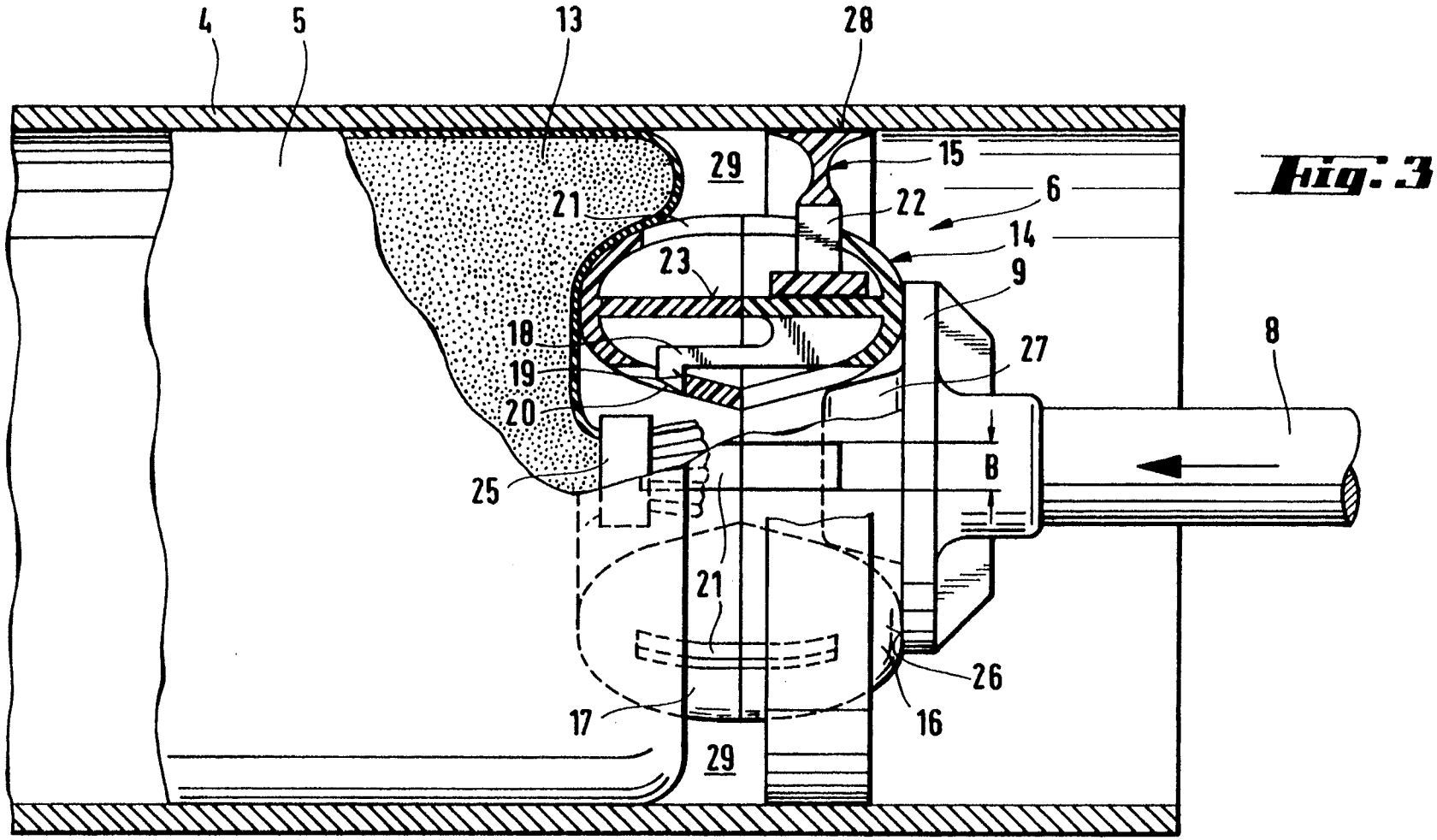
FIG. 3 is a view similar to FIG. 2, however, with the piston rod and pressure member pressing the piston against the foil bag.

The dispensing operation is shown in FIG. 3 where the mass 13 is pressed out of the foil bag 5 by the piston 6 of the present invention and is displaced axially by the combination of the piston rod 8 and the pressure member 9. The sealing surface 28 of the wipe-off edge 15 bears against the inside surface of the cassette part 4. Due to the friction between the sealing surface 28 of the wipe-off edge 15 and the inside surface of the cassette part 4, initially the wipe-off edge 15 maintains its position during the axial displacement of the central engagement part 14 until the projections 22 of the wipe-off edge contact the rearward ends of the slots 21 shaped as guides in the central engagement part 14. Upon further axial displacement of the central engagement part 14, the wipe-off edge 15 is entrained and moves in the dispensing direction. Storage space 29 is now located in the forward part of the circumferential space about the central engagement part due to the axial displacement of the wipe-off edge 15 relative to the central engagement part 14. This storage space 29 receives a portion of the collapsed or folded-up foil bag 5 as the dispensing operation proceeds.

Projection 27 extending axially from the pressure face 26 of the pressure member 9 in the dispensing direction shown in FIG. 2 extends into the central throughbore 24 of the central engagement part 14, whereby a centering action between the central engagement part 14 and the pressure member 9 is established.

As the pressure member 9 presses against the central engagement part 14, the central engagement part presses against the rear end of the foil bag and dispenses the mass 13. During the dispensing operation, the piston 6 is prevented from tilting in the cassette part 4.

While a specific embodiment of the invention has been shown and described in detail to illustrate the inventive principles, it will be understood that the invention may be embodied otherwise without departing from said principles.

I claim:

1. Piston for a tool dispensing a mass from a foil bag, comprising an axially extending piston rod (8) having a first end and a second end, an annular central engagement part (14) engageable by said piston rod at the first end thereof, and an annular wipe-off edge (15) located radially outwardly from and at least partially surrounding said central engagement part, said central engagement part (14) has a central axis extending at least parallel to said piston rod axis, wherein the improvement comprises that said wipe-off edge (15) is supported on said central engagement part (14) and is axially displaceable to a limited extent relative to said central engagement part (14).

2. Piston, as set forth in claim 1, wherein means are located in said central engagement part (14) and on said wipe-off edge (15) for effecting the limited axial displaceability of said central engagement part and said wipe-off edge.

3. Piston, as set forth in claim 2, wherein said means include radially inwardly extending projections (22) on said wipe-off edge (15).

4. Piston, as set forth in claim 3, wherein said projections have radially inwardly T-shaped free ends.

5. Piston, as set forth in claim 2, wherein said means include guides formed in said central engagement part (14).

6. Piston, as set forth in claim 5, wherein said guides are formed by axially extending slots (21) in a radially circumferential surface of said central engagement part (14) and said central engagement part (14) is hollow with said slots opening into the hollow central engagement part.

7. Piston, as set forth in claim 6, wherein said slots extend in the axial direction in the range of 70% to 90% of the axial length of the central engagement part (14).

8. Piston, as set forth in claim 6, wherein an axially extending guiding surface (23) is located within said hollow engagement part, and the T-shaped free ends of said projections (22) contact and are axially displaceable along said guiding surface (23).

9. Piston, as set forth in claim 6, wherein said central engagement part (14) has a first end and a second end spaced axially apart and extending transversely of the axial direction, a throughbore (24) extends through said central engagement part from the first end to the second end thereof, and said throughbore converges inwardly from said first and second ends to a transverse plane spaced midway between said first and second ends.

10. Piston, as set forth in claim 9, wherein said central engagement part (14) is formed of two halves (16, 17) having a parting plane corresponding to said transverse plane spaced midway between said first and second ends of said central engagement part, and said piston rod (8) has a pressure member (9) thereon engageable within said throughbore (24) of said central engagement part.

* * * * *